US006388220B1

(12) United States Patent
Sasaki et al.

(10) Patent No.: US 6,388,220 B1
(45) **Date of Patent: *May 14, 2002**

(54) ILLUMINATED SWITCHING DEVICE FOR STABILIZED ILLUMINATION TO TRANSLUCENT PORTION OF KNOB

(75) Inventors: Makoto Sasaki; Masakatsu Atumi; Nobuyuki Kowata; Kenichi Saiso, all of Miyagi-ken (JP)

(73) Assignee: Alps Electronic Co., Ltd., Tokyo (JP)

( * ) Notice: This patent issued on a continued prosecution application filed under 37 CFR 1.53(d), and is subject to the twenty year patent term provisions of 35 U.S.C. 154(a)(2).

Subject to any disclaimer, the term of this patent is extended or adjusted under 35 U.S.C. 154(b) by 0 days.

(21) Appl. No.: 09/517,246

(22) Filed: Mar. 2, 2000

(30) Foreign Application Priority Data

Mar. 11, 1999 (JP) ..... 11-065600

(51) Int. Cl.[7] ..... H01H 9/00
(52) U.S. Cl. ..... 200/537; 200/315
(58) Field of Search ..... 200/537, 310–317

(56) References Cited

U.S. PATENT DOCUMENTS 3,435,169 A * 3/1969 Beinwald et al. ..... 200/167
5,660,270 A * 8/1997 Martin et al. ..... 200/315
5,752,595 A * 5/1998 Fein et al. ..... 200/315
5,833,048 A * 11/1998 Dilly ..... 200/446
5,850,062 A * 12/1998 Botz et al. ..... 200/315
5,865,301 A * 2/1999 Kawabe et al. ..... 200/313
6,013,885 A * 1/2000 Kowalczyk ..... 200/315

FOREIGN PATENT DOCUMENTS

| | | |
|---|---|---|
| DE | 85 13 909 | 6/1985 |
| DE | 196 31 310 A1 | 2/1998 |
| EP | 0 773 568 A2 | 11/1996 |
| JP | 4-51374 | 12/1992 |

* cited by examiner

*Primary Examiner*—P. Austin Bradley
*Assistant Examiner*—Lisa N. Klaus
(74) *Attorney, Agent, or Firm*—Brinks Hofer Gilson & Lione

(57) ABSTRACT

An object of the invention is to provide a illuminated switching device comprising a small number of components and capable of giving stabilized illumination to a translucent portion of a knob. For this purpose, the illuminated switching device of the present invention has a switch section including a case and a switch terminal protruding out of the case, a printed-circuit board to which the switch terminal is connected, and a lamp having a pair of lamp terminals connected with the printed-circuit board. The lamp terminals are retained and supported on the case.

5 Claims, 4 Drawing Sheets

ILLUMINATED SWITCHING DEVICE FOR STABILIZED ILLUMINATION TO TRANSLUCENT PORTION OF KNOB

BACKGROUND OF THE INVENTION

1. Field of the Invention

This invention relates to an illuminated switching device and more particularly to an illuminated switching device suitable for use in opening and closing a window by a power window system on a motor vehicle.

2. Description of Related Art

Referring to the accompanying drawings, a conventional illuminated switching device will be explained.

FIG. 6 is a side view showing the conventional illuminated switching device; and FIG. 7 is a side view showing the illuminated switching device of FIG. 6 with a knob removed.

As shown in FIGS. 6 and 7, a switch section 11 of a illuminated switching device C is made of a synthetic resin material such as a glass-filled epoxy resin material, and comprises a case 11*a* formed in an approximately box shape by a molding process, an unillustrated stationary contact housed in the case 11*a*, an unillustrated moving contact, an operating member 11*b* which is rockably supported on the upper surface side of the case 11*a*, and a plurality of (e.g., six) L-shaped switch terminals 11*c* connected to the unillustrated stationary contact.

The case 11*a* includes an upper case 11*d* and a lower case 11*e*. The upper case 11*d* and the lower case 11*e* are retained as one body by an appropriate means such as a snap-in engagement means. A switch terminal 11*c* of an approximately L-shape protrudes outwardly from the side wall of the lower case 11*e*. On the operating member 11*b*, a knob 15 with a later-described translucent portion 15*b* is retained.

A printed-circuit board 12 is made of for instance a synthetic resin such as a glass-filled epoxy resin material, and is formed in a flat plate shape. On at least one side (e.g., the back side) is formed an unillustrated circuit pattern of a specific configuration.

The printed-circuit board 12 has a plurality of (e.g., six) switch terminal holes 12*a* and plural sets of round through holes 12*b* (e.g., two sets including four holes in all: two holes per set). Around the switch terminal hole 12*a* and the through hole 12*b*, a wiring pattern is provided. The through holes 12*b* in one set are arranged at a spacing L1.

In the switch terminal hole 12*a* of the printed-circuit board 12, the switch terminal 11*c* of the switch section 11 is inserted with the bottom surface of the lower case lie of the switch section 11 set on the printed-circuit board 12. The forward end portion of the switch terminal 11*c* is soldered to the wiring pattern not depicted.

A holding member 13 is molded in an approximately rectangular shape of a synthetic resin material such as a phenolic resin material. The holding member 13 has a pair of (two) rectangular insertion holes 13*a*. The insertion holes 13*a* are formed through the upper surface side to the lower surface side, and are arranged at a spacing L1.

The holding member 13 is mounted in the vicinity of the switch section 11 on the printed-circuit board 12. The insertion hole 13*a* and the through hole 12*b* of the printed-circuit board 12 are so arranged that the axes of the holes 12*b* and 13*b* will be aligned.

A lamp 14 has an illuminating portion 14*a* including a light-emitting device (LED) and a pair of lamp terminals 14*b* parallelly protruding out of the illuminating portion 14*a*. The pair of lamp terminals 14*b* are arranged at a spacing L1. There is provided a uniform, equal spacing between the illuminating portion 14*a* and the free end portion (forward end portion) of the lamp terminal 14*b*.

On the pair of lamp terminals 14*b*, a crank-like bent portion 14*c* is formed. The lamp terminals 14*b* of the lamp 14 are parallelly inserted in the insertion hole 13*a* of the holding member 13 and a set of through holes 12*b* of the printed-circuit board 12. The forward ends of the lamp terminals are soldered to the wiring pattern not shown.

The lamp terminal 14*b* is held by the holding member 13 on the printed-circuit board 12. The illuminating portion 14*a* is extended to the vicinity of the operating member 11*b* of the switch section 11, and the bent portion 14*c* is disposed in the vicinity of the upper case 11*d* of the switch section 11. In this state, the size between the illuminating portion 14*a* and the insertion hole 13*a* of the holding member 13, inclusive of the bent portion 14*c*, is relatively long; the illuminating portion 14*a*, therefore, is unstably supported.

The knob 15 is made by molding of an insulating molding material for example, and has an opaque pushing portion 15*a*, a translucent portion 15*b* provided at a desired part of the pushing portion 15*a* and made of a transparent or opaque insulating molding material, and an approximately rectangular recess portion 15*c* provided in the back side. The recess portion 15*c* of the knob 15 is retained by a suitable means to the operating member 11*b* of the case 11*a*, thus :forming the knob 15 and the case 11*a* in one body.

The illuminating portion 14*a* is disposed in the vicinity of the bottom side of the translucent portion 15*b* of the knob 15. The translucent portion 15*b* is illuminated bright with the light from the illuminating portion 14*a*, being displayed in a raised state.

The illuminated switching device C thus constituted is disposed by an approximate means within a cabinet 16. When the switching device C is in this state, the knob 15 is disposed protruding out through an opening 16*a* provided in the cabinet 16.

Next, operation of the illuminated switching device C will be explained.

The illuminated switching device C is designed such that when the pushing portion 15*a* of the knob 15 is depressed and the knob 15 is swung, the operating member 11*b* engaged with the knob 15 is actuated. With the operation of the operating member 11*b*, the moving contact moves to and from the stationary contact, thus operating the contact on and off.

The lamp 14 of this illuminated switching device C is so arranged as to be turned on simultaneously with illumination of unillustrated headlamps of a motor vehicle (an automobile).

The conventional illuminated switch device C described above has such a problem that the lamp 14, retained by means of the holding member 13, needs this holding member 13, resulting in an increased component count. Furthermore, since a mounting spacing is needed for installing the holding member 13 on the printed-circuit board 12, upsizing the illuminated switching device will become imperative.

Because the length of the lamp terminal 14*b* from the upper end surface of the holding member 13 to the illuminating portion 14*a* is long, the lamp terminal 14*b* totters with the vibration of the illuminated switching device C. With this vibration, light emission to the translucent portion 15*b* of the illuminating portion 14*a* will totter in an unstable state.

Since the spacing L1 between a set of through holes 12*b* of the printed-circuit board 12 and the spacing between a pair of lamp terminals 14*b* of the lamp 14 are set at the same size, the lamp terminal 14*b* can easily be inserted into the through hole 12*b*. However, the illuminating portion 14*a* of the lamp 14 is hard to position at a given level above the printed-circuit board 12; and therefore the illuminating portion 14*a* of the lamp 14 to be mounted on the printed-circuit board 12 will not be set at a given height. Furthermore, because the spacing L1 between the lamp terminals 14*b* is narrow, the lamp 14 supported is likely to be unstable.

SUMMARY OF THE INVENTION

Accordingly it is an object of this invention to provide an illuminated switching device comprising a small number of components and capable of giving stabilized illumination to the translucent portion of a knob for purpose of solving the above-described problem.

The illuminated switching device of this invention is comprised of a switching section having a case and switch terminals protruding out of the case, a printed-circuit board with which the switch terminals are connected, and a lamp having a pair of lamp terminals connected to the printed-circuit board; the lamp terminals being supported by locking in the case.

Furthermore, in the illuminated switching device of this invention, the lamp terminals are provided with crank-like bent portions, which are retained in a groove portion of the case. The free ends of the lamp terminals are inserted through the through holes in the printed-circuit board.

Furthermore, the illuminated switching device of this invention has a groove portion formed in the side end face on the upper surface side of the case.

Furthermore, in the illuminated switching device of this invention, the free ends of the pair of lamp terminals are arranged at a wider distance than the other ends of the lamp terminals on the lamp side.

According to the illuminated switching device of this invention, the lamp terminals are retained on the case as described above; and therefore no holding member is needed for holding the lamp terminals of the conventional illuminated switching device. Therefore it is possible to provide a low-cost, down-sized illuminated switching device, the component count of which can be reduced to enable easy assembling.

Furthermore according to the illuminated switching device of this invention, since the crank-like bent portion of the lamp terminal is retained in the groove in the case, the lamp can easily be positioned by the case, to thereby insure stable arrangement of the lamp and the printed-circuit board. Also, since the length between the illuminating portion and the bent portion is relatively short, the illuminating portion will not totter if vibrated, to thereby enable stabilized illumination to the translucent portion.

Furthermore, according to the illuminated switching device of this invention, since the groove portion of the case for retaining the crank-like bent portion of the lamp terminal is formed in the side end face on the upper surface side of the case, the bent portion of the lamp terminal can be easily retained.

Furthermore, according to the illuminated switching device of this invention, the spacing between the free ends of the lamp terminals is set wider than that between the fixed ends of the lamp terminals on the lamp side, and therefore the lamp terminals are so arranged as to pinch the through hole portion when inserted into the through holes. Also since the bent portions are pressed into the grooves in the case, the lamp can be firmly attached to the printed-circuit board and the case, thus insuring stabilized mounting of the lamp.

Other objects, together with the foregoing, are attained in the embodiments described in the following description and illustrated in the accompanying drawings.

DESCRIPTION OF THE PREFERRED EMBODIMENTS

An illuminated switching device of this invention will hereinafter be described with reference to the accompanying drawings.

Figure 1:
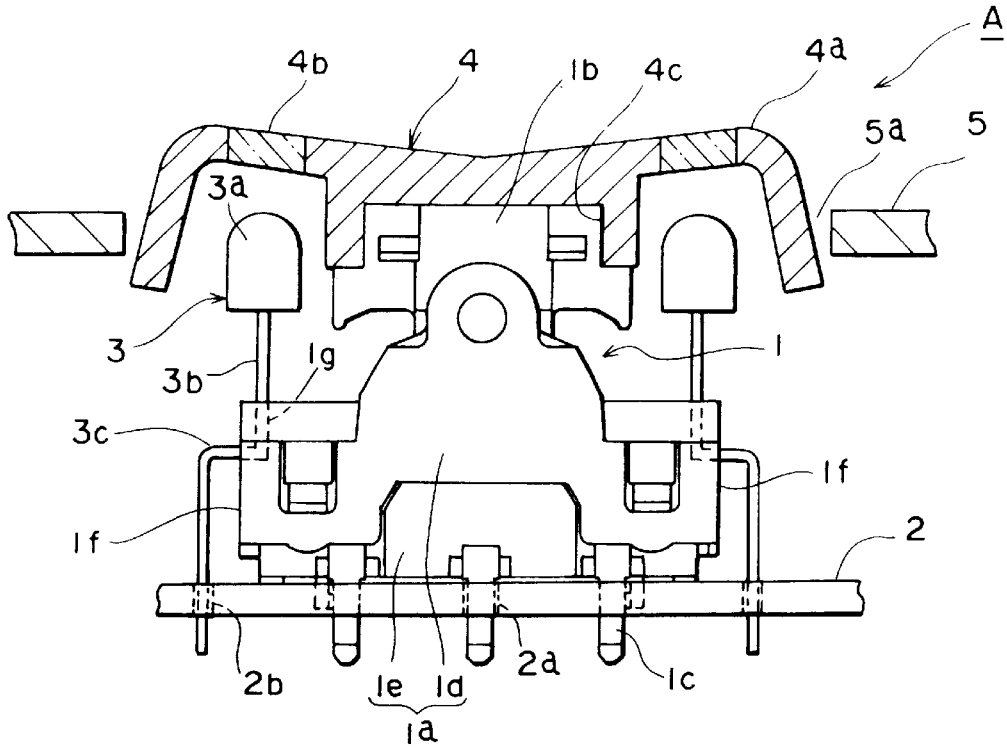
FIG. 1 is a front view showing an embodiment of an illuminated switching device of this invention.
Figure 2:
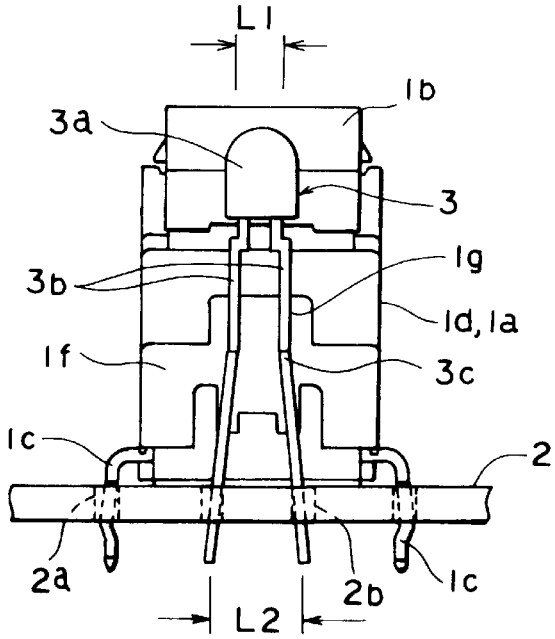
FIG. 2 is a side view showing the illuminated switching device of FIG. 1 with a knob removed.
Figure 3:
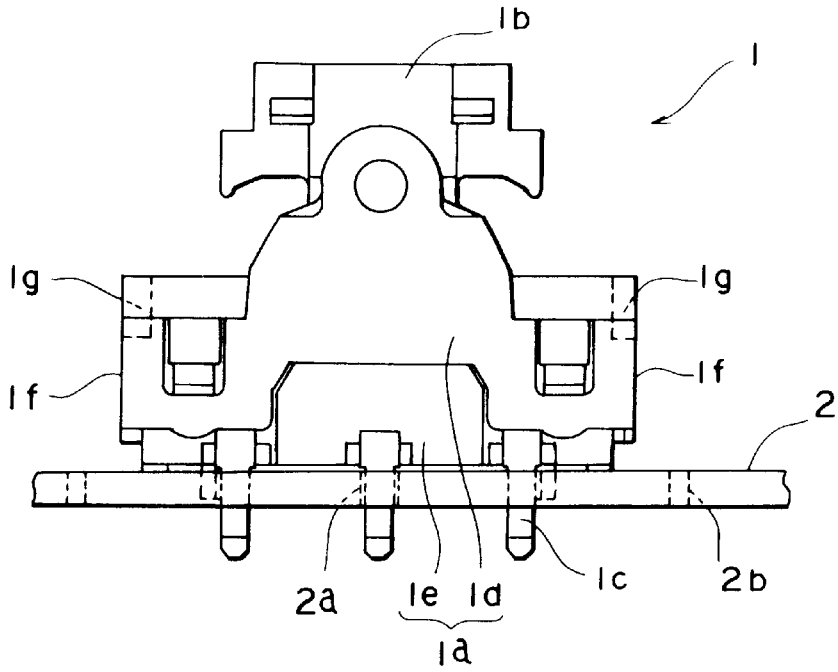
FIG. 3 is a front view showing an embodiment of a switch section and a printed-circuit board of the illuminated switching device of this invention.
Figure 4:
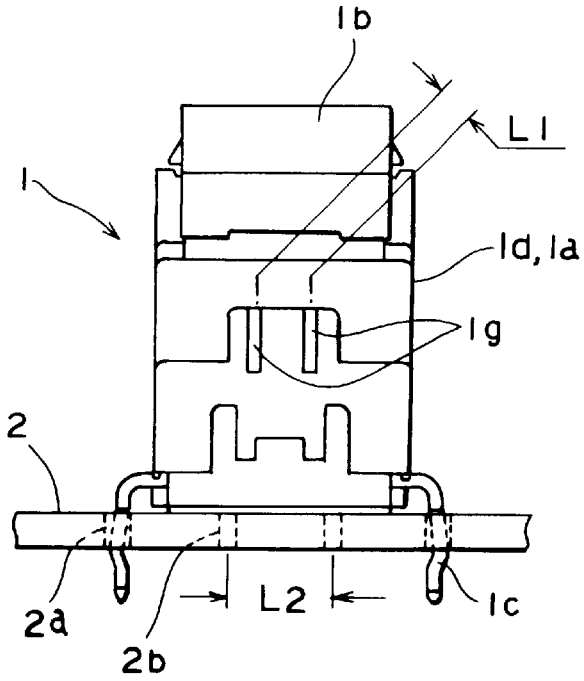
FIG. 4 is a side view of FIG. 3.

FIG. 1 is a front view showing an embodiment of the illuminated switching device of this invention; FIG. 2 is a side view showing the illuminated switching device of FIG. 1 with the knob removed; FIG. 3 is a front view showing another embodiment showing a switch section and a printed-circuit board of the illuminated switching device according to this invention; and FIG. 4 is a side view of FIG. 3.

As shown in FIGS. 1 to 4, a switch section 1 of the illuminated switching device A is made of an insulating synthetic resin material such as a glass-filled epoxy resin material, and includes a case la formed by molding approximately into a shape of box, an unillustrated stationary contact housed in the case 1*a* and an unillustrated moving contact, an operating member 1*b* rockably pivoted on the upper surface side of the case 1*a*, and a plurality of (e.g., six) L-shaped switch terminals 1*c* connected (extended) with the stationary contact not shown.

The case 1*a* is comprised of an upper case 1*d* and a lower case 1*e*. The upper case 1*d* and the lower case 1*e* are retained as one body by an appropriate means such as a snap-in engagement means. The switch terminal 1*c* is approximately L-shaped, protruding out of the side wall of the lower case 1*e*. On the operating member 1*b* a knob 4 having a later-described translucent portion 4*b* is fitted.

On the opposite side end faces 1*f*, 1*f* on the upper surface side of the upper case 1*d*, there are parallelly formed a pair of grooves 1*g* at a spacing of L1. The grooves 1*g* are formed to a given depth from the upper surface side to the lower surface side.

A printed-circuit board 2 is made of for instance such a synthetic resin material as a glass-filled epoxy resin material, and is formed to a flat plate shape. And an unillustrated wiring pattern having a given configuration is formed at least on one surface side (e.g., on the back side).

Furthermore, the printed-circuit board 2 has a plurality of (e.g., six) switch terminal holes 2*a*, and plural sets (pieces) (e.g., two sets including four holes in all: two holes per set) of round through holes 2*b*. Around the switch terminal holes 2*a* and the through holes 2*b*, a wiring pattern is arranged. Each set of through holes 2*b* are arranged at a spacing L2, which is larger than the spacing L1 (L2>L1) of the grooves 1*g*.

In the switch terminal holes 2*a* in the printed-circuit board 2, the switch terminals 1*c* of the switch section 1 are inserted. At this time the lower case 1*e* of the switch section 1 is placed with its bottom surface set on the printed-circuit board 2. The forward end portion of the switch terminal 1*c* is soldered to the wiring pattern not shown.

A lamp 3 has an illuminating portion 3*a* comprising a light-emitting device (LED), and a pair of lamp terminals 3*b* protruding out of the illuminating portion 3*a*. The pair of lamp terminals 3*b* are arranged approximately at a spacing L2 at the forward end portion. (free end portion), with the, terminals on the illuminating portion (upper end portion) 3*a* side spaced at the size L1 (L2>L1).

In about the middle part of the pair of lamp terminals 3*b*, there is formed a crank-like bent portion 3*c*. The lamp terminals 3*b* are spread wider as they go from the bent portion 3*c* toward the forward end portion side. The forward end portions are inserted into a set of through holes 2*b* in the printed-circuit board 2, and soldered to the wiring pattern not shown.

When the illuminated switch device is in this state, the bent portions 3*c* of the pair of lamp terminals 3*b* are retained in the pair of grooves 1*g* of the upper case 1*d*. In this state, the upper end portion of the lamp terminal 3*b* protrudes out of the upper case 1*d*, and the illuminating portion 3*a* is disposed in the vicinity of the operating member 1*b* of the switch section 1. Therefore, the length of the lamp terminals 3*b* between the illuminating portion 3*a* to the bent portion 3*c* retained in the groove 1*g* is relatively short.

The knob 4 is made by molding an insulating molding material for example, and has an opaque pushing portion 4*a*, a translucent portion 4*b* made of a transparent or translucent insulating molding material and provided in a desired position of the pushing portion 4*a*, and an approximately rectangular recess portion 4*c* formed on the back side. The knob 4 is retained at the recess portion 4*c* by a suitable means such as a snap-in engagement means to the operating member 1*b* of the case 1*a*, thereby forming the knob 4 and the case 1*a* as one body.

The illuminating portion 3*a* is located near the bottom surface side of the translucent portion 4*b* of the knob 4. When the illuminating portion 3*a* is lit, the translucent portion 4*b* is illuminated bright, being so displayed as to be raised.

The illuminated switching device A of the above-described configuration is housed and disposed by a suitable means within a cabinet 5 made of a synthetic resin material for example. In this state, the knob 4 is arranged protruding out through an opening 5*a* provided in the cabinet 5.

Next, operation of the illuminated switching device A will be explained.

The illuminated switching device A is of such a design that when the pushing portion 4*a* of the knob 4 is depressed to rock the knob 4 thereby driving (rocking) the operating member 1*b* which is engaged with the knob 4. With the driving of the operating member 1*b*, the moving contact of the switch section 1 goes to and from the stationary contact, thus opening and closing the contact.

The lamp 3 of the illuminated switching device A is so arranged as to be illuminated simultaneously with the lighting of unillustrated headlamps of a motor vehicle (automobile).

Figure 5:
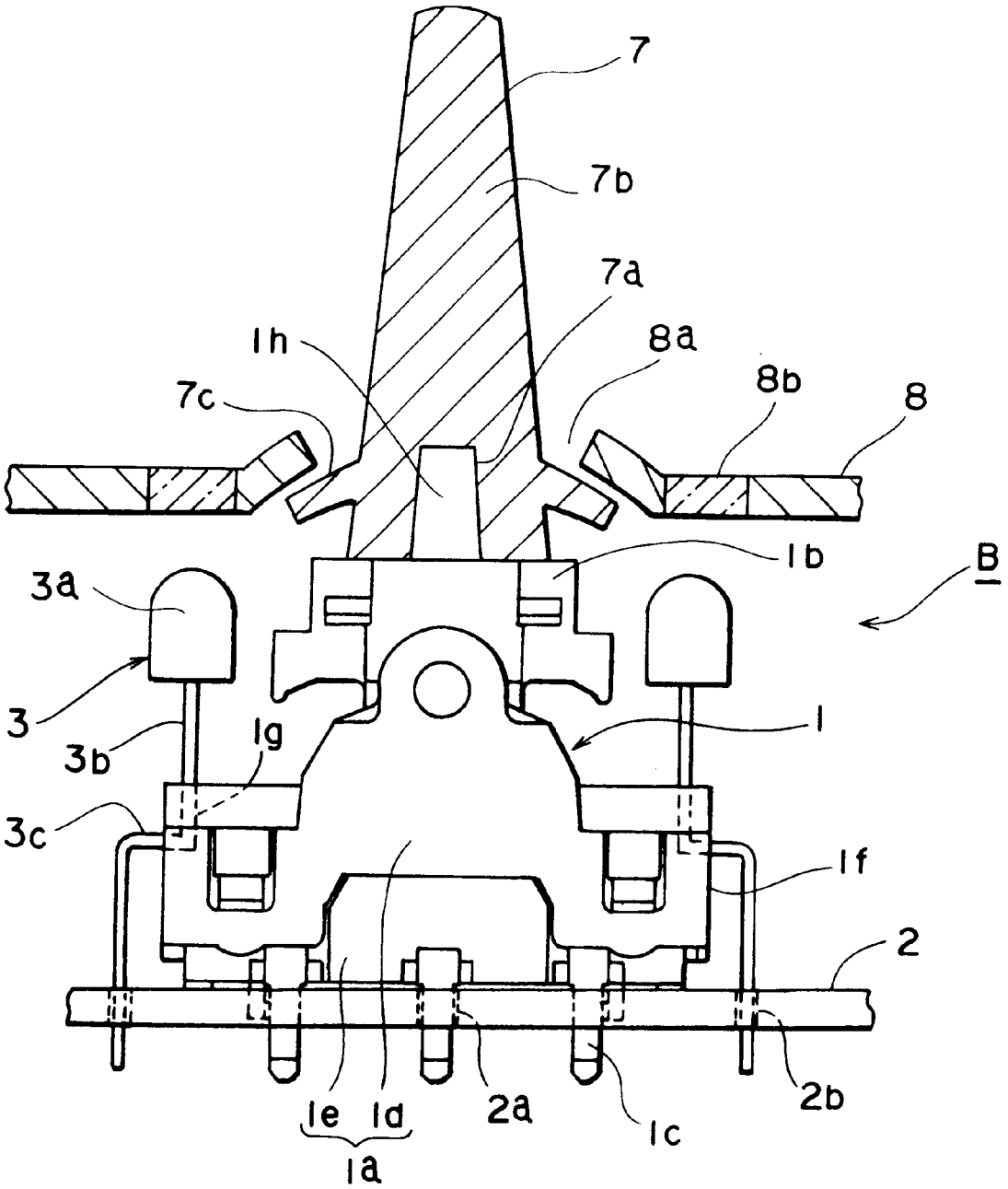
FIG. 5 is a front view showing the second embodiment of the illuminated switching device of this invention.
Figure 6:
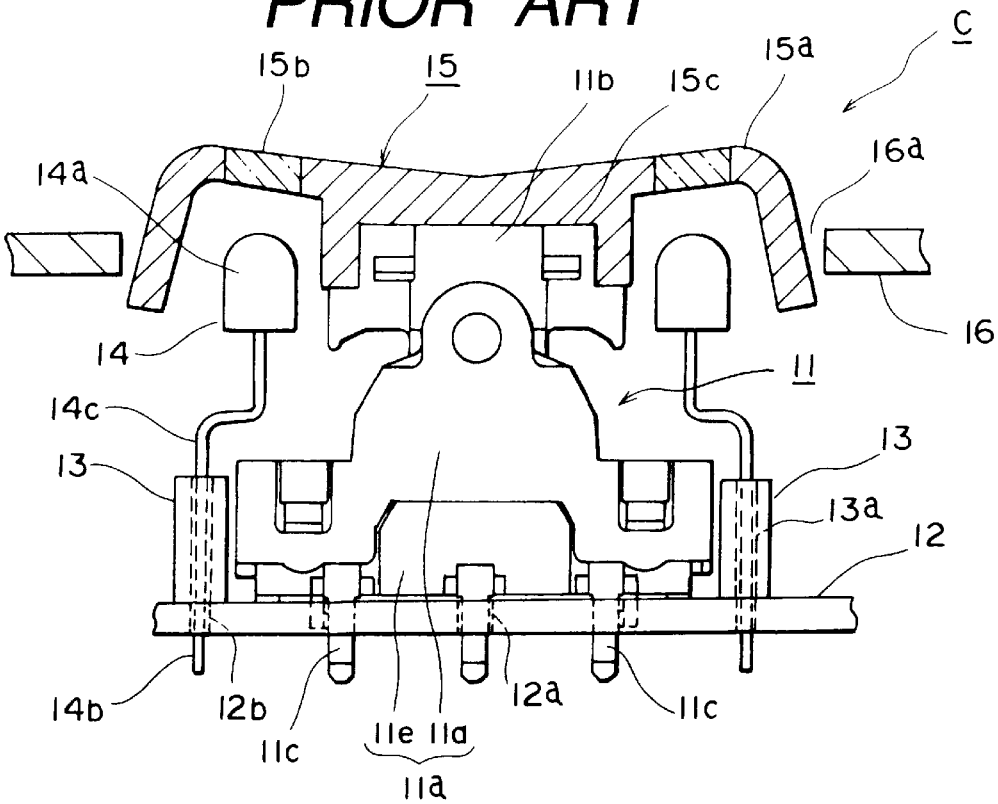
FIG. 6 PRIOR ART
FIG. 6 is a front view showing a conventional illuminated switching device.
Figure 7:
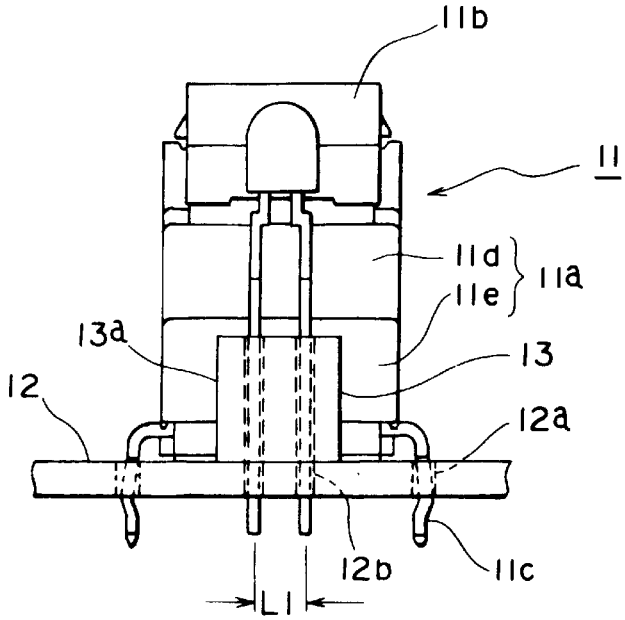
FIG. 7 PRIOR ART
FIG. 7 is a side view showing the illuminated switching device of FIG. 6 with the knob removed.

Next, the second embodiment of the illuminated switching device according to this invention will be explained. FIG. 5 is a front view showing the second embodiment of the illuminated switching device according to this invention. In this illuminated switching device, the same members as those of the first embodiment will be designated with the same reference numerals and will not be described.

The illuminated switching device B differs from the illuminated switching device A of the first embodiment in the respect. In the illuminated switching device A, the knob 5 is provided with a translucent portion 5*b* which is illuminated and displayed by the illuminating portion 4*a* of the lamp 4; in the illuminated switching device B of the second embodiment, however, a translucent portion 8*b* of a cabinet 8 is illuminated and displayed by the illuminating portion 4*a* of the lamp 4.

Next, the second embodiment of the illuminated switching device will be explained.

As shown in FIG. 5, the operating member 1*b* of the case 1*a* is provided with a projecting portion 1*h* of approximately trapezoidal section protruding outwardly.

A knob 7 is made of a synthetic resin material by molding, and has a control portion 7*b*, a recess portion 7*a* formed in one end portion (root side) of the control portion 7*b*, and a collar portion 7*c* formed around the control portion 7*b*. In the recess portion 7*a* of the knob 7, the projecting portion 1*h* of the case 1*a* is inserted; thus forming the case 1*a* and the knob 7 as one unit by bonding with a suitable means such as an adhesive not depicted.

The cabinet 8 are made of for instance an insulating synthetic resin material by molding, and has an opening 8*a* and a translucent portion 8*b* of transparent or translucent insulating molding material provided in the vicinity of the opening 8*a*. In the cabinet 8 the illuminated switching device B is housed and set by a suitable means. In this state, the knob 7 is mounted protruding out from the opening portion 8*a* of the cabinet 8.

The illuminating portion 3*a* of the lamp 3 is located in the vicinity of the back side of the translucent portion 8*b*, and the translucent portion 8*b* will be displayed so as to be raised by illumination to the translucent portion 8*b* of the illuminating portion 3*a*.

The illuminated switching device B operates similarly to the illuminated switching device A of the above-described first embodiment and therefore will not be described.

What is claimed is:

1. An illuminated switching device, comprising:

a switch section having a case and switch terminals protruding out of the case;

a printed-circuit board with which the switch terminals are connected; and a lamp having an illuminating portion and a pair of lamp terminals, each lamp terminal comprising a free end connected with the printed-circuit board and a crank-like bent portion supported by the case, wherein the case is provided with a pair of groove portions on an outside surface of the case, each said groove portion being formed in a side end face on an upper surface side of the case, and the crank-like bent portion of each lamp terminal is inserted in the groove portion so as to be supported by the case, said illuminating portion being positioned at a fixed elevation by retaining the crank-like bent portion in said groove portion, and wherein the free ends of the pair of lamp terminals are each inserted in through holes formed in the printed-circuit board, said through holes being spaced apart from the pair of groove portions formed in the case.

2. An illuminated switching device according to claim 1, wherein the free ends of the pair of lamp terminals are spaced wider than the other ends of the lamp terminals on a lamp side.

3. An illuminated switching device according to claim 2, wherein the pair of groove portions are spaced at a width that is approximately equal to the spacing of the other ends of the lamp terminals on the lamp side.

4. An illuminated switching device according to claim 3, wherein said lamp comprises a plurality of lamps, each of said plurality of lamps comprising a pair of lamp terminals supported by a pair of grooves portions formed on the outside of the case.

5. An illuminated switching device according to claim 1, wherein said lamp comprises a plurality of lamps, each of said plurality of lamps comprising a pair of lamp terminals. supported by a pair of grooves portions formed on the outside of the case.

* * * * *

UNITED STATES PATENT AND TRADEMARK OFFICE

CERTIFICATE OF CORRECTION

PATENT NO. : 6,388,220 B1
DATED : May 14, 2002
INVENTOR(S) : Makoto Sasaki et al.

It is certified that error appears in the above-identified patent and that said Letters Patent is hereby corrected as shown below:

Title page,
Item [56], U.S. PATENT DOCUMENTS, delete "Beinwald et al." and substitute -- Bienwald et al. -- in its place.

Column 8,
Line 8, immediately after "lamp terminals" delete "." (period).

Signed and Sealed this

Thirtieth Day of December, 2003

JAMES E. ROGAN
*Director of the United States Patent and Trademark Office*